US011230743B2

(12) United States Patent
Kaufmann et al.

(10) Patent No.: US 11,230,743 B2
(45) Date of Patent: Jan. 25, 2022

(54) METHOD OF MANUFACTURING A TUBULAR PRODUCT AND TUBULAR PRODUCT

(71) Applicant: Benteler Steel/Tube GmbH, Paderborn (DE)

(72) Inventors: Michael Kaufmann, Paderborn (DE); Marco Walterfang, Paderborn (DE); Ralf Köster, Schlangen (DE)

(73) Assignee: Benteler Steel/Tube GmbH, Paderborn (DE)

( * ) Notice: Subject to any disclaimer, the term of this patent is extended or adjusted under 35 U.S.C. 154(b) by 0 days.

(21) Appl. No.: 16/793,214

(22) Filed: Feb. 18, 2020

(65) Prior Publication Data

US 2020/0263266 A1 Aug. 20, 2020

(30) Foreign Application Priority Data

Feb. 19, 2019 (DE) ..... 10 2019 104 167.8

(51) Int. Cl.

| | |
|---|---|
| ***C21D 1/22*** | (2006.01) |
| ***C21D 1/63*** | (2006.01) |
| ***C22C 38/04*** | (2006.01) |
| ***C22C 38/06*** | (2006.01) |
| ***C22C 38/24*** | (2006.01) |
| ***C22C 38/26*** | (2006.01) |
| ***C22C 38/28*** | (2006.01) |
| ***C21D 9/08*** | (2006.01) |

(52) U.S. Cl.

CPC ..... *C21D 1/22* (2013.01); *C21D 1/63* (2013.01); *C21D 9/085* (2013.01); *C22C 38/04* (2013.01); *C22C 38/06* (2013.01); *C22C 38/24* (2013.01); *C22C 38/26* (2013.01); *C22C 38/28* (2013.01); *C21D 2211/001* (2013.01)

(58) Field of Classification Search

None

See application file for complete search history.

(56) References Cited

U.S. PATENT DOCUMENTS

2005/0034790 A1* 2/2005 Amaya ..... C22C 38/44 148/325

FOREIGN PATENT DOCUMENTS

DE 699 28 635 T2 6/2000

* cited by examiner

*Primary Examiner* — Nicholas A Wang
*Assistant Examiner* — Anthony M Liang
(74) *Attorney, Agent, or Firm* — Pandiscio & Pandiscio

(57) ABSTRACT

The present invention relates to a method for manufacturing a tubular product, characterized in that the tubular product is manufactured from steel comprising chromium in the range of 2.5 to 9.5 wt. % and silicon in an amount of more than 1.0 wt. %, and the method comprises the steps of austenitizing, quenching and tempering at a tempering temperature in the range of 300° C. to 550° C. Furthermore, the invention concerns a tubular product produced by this method.

17 Claims, 8 Drawing Sheets

METHOD OF MANUFACTURING A TUBULAR PRODUCT AND TUBULAR PRODUCT

REFERENCE TO PENDING PRIOR PATENT APPLICATION

This patent application claims benefit of German Patent Application No. DE 10 2019 104 167.8, filed Feb. 19, 2019, which patent application is hereby incorporated herein by reference.

FIELD OF THE INVENTION

This invention relates to a process for manufacturing a tubular product and a tubular product.

BACKGROUND OF THE INVENTION

In many applications of tubular steel products, corrosion resistance is of particular relevance. For known corrosion resistant steels, chromium is used as an alloying element to increase the corrosion resistance. However, such steels suffer from local chromium degradation due to carbide formation in the structure. This allows a local corrosion attack, which is also known as pitting, to occur. To reduce this effect, the carbon content can be kept low and the amount of chromium in the alloy can be increased. However, this limits the strength of the steel and increases manufacturing costs.

SUMMARY OF THE INVENTION

The task of the present invention is therefore to avoid corrosion, especially local corrosion, in a tubular product in a simple way and especially at low manufacturing costs.

The invention is based on the finding that this problem can be solved by using a steel with moderate chromium content and increased silicon content and subjecting it to a special heat treatment.

According to a first aspect, the invention therefore relates to a method for manufacturing a tubular product. The method is characterized in that the tubular product is made of a steel having chromium in the range of 2.5 to 9.5 wt. % and silicon of more than 1.0 wt. %, and the method comprises the steps of austenitizing, quenching and tempering at a tempering temperature in the range of 300° C. to 550° C.

The steel from which the tubular product according to the invention is made consists, according to the invention, of a steel alloy comprising chromium in the range from 2.5 to 9.5 wt. %, in particular in the range from 2.5 to 8 wt. %, and silicon of more than 1.0 wt. %.

As the steel alloy has—in comparison to conventional chromium steels with a chromium content of more than 10.5 wt. %—a lower chromium content, the manufacturing costs are reduced. However, since at least 2.5 wt. % chromium, Cr, is contained in the alloy, the tubular product made of this steel alloy still has good corrosion resistance.

As the silicon content, Si, of the steel alloy used according to the invention is also more than 1 wt. %, the precipitation of carbides, especially cementite, can be reliably suppressed. Since these carbides in corrosive environments deplete the structure locally of chromium and since cementite also serves locally as a cathode, which accelerates corrosion in the surrounding structure, the addition of more than 1 wt. % of silicon prevents local corrosion, also known as pitting. If not defined differently, the structure of the tubular product or steel refers to the microstructure of the tubular product of the steel of which the tubular product is made.

The method according to the invention comprises the steps of austenitizing, quenching and tempering. This heat treatment is also referred to as Quenching and Tempering (Q&T). According to the invention, tempering takes place at a tempering temperature in the range of 300° C. to 550° C. Quenching is preferably carried out at a temperature below the martensite finish temperature (Mf temperature), whereby a martensitic structure is formed. As a result of the subsequent low tempering temperature, the formation of special carbides is avoided. The structure of the tubular product preferably consists of tempered martensite with a retained austenite content of less than 25%, preferably less than 20% retained austenite. Preferably ferrite, perlite and bainite are not present in the structure of the tubular product or only in very small quantities, in particular <10%.

According to a preferred embodiment, the tempering temperature is in the range of 350° C. to 450° C. and preferably 400° C. At these temperatures the formation of special carbides can be reliably prevented.

According to an embodiment, the steel from which the tubular product is made, consists, except for iron and unavoidable impurities due to melting, of the following alloying elements in wt. %:

| | |
|---|---|
| C | 0.05-0.3 |
| Si | 1.1-4 |
| Mn | 0.5-2.0 |
| Cr | 2.5-9.5 |
| Al | 0.01-0.1 |

and at least one of the following alloying elements in the specified ranges in wt. %:

| | |
|---|---|
| Nb | 0.001-0.1 |
| V | 0.001-0.2 |
| Ti | 0.001-0.1 |
| Mo | 0.001-0.7. |

Indications of the amounts of the alloying elements, which are stated in percent, refer to wt. %.

By carbon (C) the formation of martensite is promoted. Due to the low tempering temperatures, the strength is also adjusted by the addition of carbon. If the carbon content is too high, however, the processability of the steel alloy is made more difficult. Therefore, the carbon content in the preferred steel alloy is limited to a maximum of 0.3%.

Silicon (Si) is used as a deoxidizing agent in the manufacturing of steel alloys. In addition, in the present invention silicon prevents the formation of carbides, especially cementite ($Fe_3C$). With an addition of silicon of 1% or less, carbide formation cannot be reliably suppressed; with an addition of silicon of more than 4%, to the contrary, the processability of the steel alloy is impaired. The silicon content is therefore preferably in the range of 1.1-3% and particularly preferred in the range of 1.5-2%. In particular, at the low tempering temperature according to the invention and the high silicon content, the carbide formation, both the cementite formation and the formation of special carbides, is delayed. The steel according to the invention contains a fraction of retained austenite after austenitizing and quenching. Retained austenite binds the carbon of the alloy, which further improves the corrosion properties. In addition, the retained austenite acts as a hydrogen trap.

Manganese (Mn) is preferably added in an amount ranging from 0.5 to 2.0%. Too high a manganese content in the steel alloy has a negative effect on weldability. The manganese content, for example, can be in a range from 0.5 to 1.0%.

Chromium (Cr) is added in a quantity of 2.5 to 9.5% according to the invention. The addition of chromium in this range can improve the corrosion resistance of the steel alloy. Furthermore, the costs for the manufacturing of the tubular product are reduced compared to chromium steels with chromium contents of >10.5%, for example. Preferably, the chromium content of the steel alloy used according to the invention is in the range of 2 to 8%, in particular in the range of 3-7%.

Aluminum (Al) is used as a deoxidizing agent in the manufacturing of the steel alloy and for binding nitrogen. Preferably, aluminum is present in the range of 0.01-0.1% and further preferred the aluminum content is 0.02%.

Niobium (Nb) is present in the steel alloy preferably in the range from 0.001 to 0.1%. For example, the niobium content can be in the range 0.01-0.0375%. Particularly preferred, the niobium content is 0.0175%. Niobium can act as a hydrogen trap.

Additionally or alternatively to niobium, vanadium (V) and molybdenum (Mo) can be added to the alloy individually or in combination. Herein, at least one of the following alloying elements is present in the indicated content ranges in wt. %:

| | |
|---|---|
| Nb | 0.001-0.1 |
| V | 0.001-0.2 |
| Mo | 0.001-0.7. |

Additionally or alternatively to these alloying elements, Nb, V and Mo, titanium (Ti) can be added to the alloy in a quantity in the range of 0.001-0.1%.

The tubular product is preferably tempered for less than 120 minutes, for less than 60 minutes, for less than 30 minutes or for more than 5 minutes. This reliably prevents the formation of transition carbides.

According to a preferred embodiment, quenching after austenitizing is performed with water. This ensures that a reliable formation of the predominantly martensitic structure is achieved. In this embodiment, the heat treatment is also referred to as water quenching and tempering. As an alternative to water, oil or a two-component medium can also be used.

According to another aspect, this invention refers to a tubular product which is characterized in that it is manufactured by the method according to the invention.

Advantages and characteristics described with regard to the method also apply—as far as applicable—to the tubular product according to the invention.

A steel tube or a workpiece produced by further processing of the steel tube is referred to as a tubular product. In particular, further processing can be a machining operation, such as the forming of a thread, or a non-machining operation, such as the upsetting of one or both tube ends or bending of the steel tube.

The tubular product according to the invention shows an increased resistance to local corrosion, which results in particular from the suppression of carbide precipitation. In addition, the formation of special carbides is prevented in particular by the low tempering temperature according to the invention. Thus, in the case of a tubular product according to the invention, there is no or only slight local corrosion, which occurs in the presence of carbides due to local chromium depletion during corrosion attack. Instead, a uniform ablation of the surfaces of the tubular product can be guaranteed, which increases the duration within which the tubular product can be reliably used.

Preferably, in the case of a tubular product according to the invention, the surface is thus uniformly ablated in the event of corrosion. In particular, the ablation of the surface of the tubular product according to the invention is uniform even in the case of sweet gas corrosion. Sweet gas corrosion can also be referred to as $CO_2$ corrosion. However, the tubular product is also resistant to local corrosion in salt water.

According to a preferred embodiment the density of the carbides in the structure of the tubular product is below $10^{22}$ $m^{-3}$, preferably below $10^{21}$ $m^{-3}$.

According to a preferred embodiment, the mean size of the carbides in the structure of the tubular product is <20 nm. Preferably >50% of the carbides in the structure of the tubular product have a size of less than 15 nm.

Due to the low density and the small size of the carbides, the risk of occurrence of local corrosion can be reduced.

The tubular product according to the invention preferably has a tensile strength, Rm, of at least 650 MPa, preferably at least 700 MPa, in particular at least 800 MPa. However, the tensile strength should not exceed 1,600 MPa. The tubular product preferably has a yield strength of at least 550 MPa and is preferably limited to a maximum of 1,100 MPa. The high strength is achieved due to the water quenching followed by tempering and the alloy composition with moderate chromium content and high silicon content. Due to the high strength in combination with the resistance to local corrosion, the tubular product is suitable for a variety of applications.

The tubular product may, for example, be an OCTG product. OCTG products (Oil Country Tubular Goods) are tubular products that are used to extract and transport oil. Examples of such tubular products are OCTG tubes such as drill tubes, casing tubes or riser tubes. In particular, in the case of production of humid gases that simultaneously contain $CO_2$, as well as in case of extraction waters and other liquids present in gas or oil production, sweet gas corrosion may occur. Since the tubular product according to the invention is resistant to this corrosion and in particular the local corrosion is minimized or prevented, the tubular product is particularly well suited for these applications.

However, the tubular product according to the invention can also be a tubular product for maritime applications or for nautical shipping. The tube according to the invention is also resistant to sea water. In particular, also no or only slight local corrosion occurs in this medium.

The tubular product according to the invention is preferably a seamless tubular product. As a result, the surface quality of the tubular product can be uniform over its surface and thus the ablation in the event of corrosion can also be uniform.

BRIEF DESCRIPTION OF THE DRAWINGS

This invention will be explained in more detail below with reference to the enclosed figures, wherein.

DETAILED DESCRIPTION OF THE PREFERRED EMBODIMENTS

Figure 1:
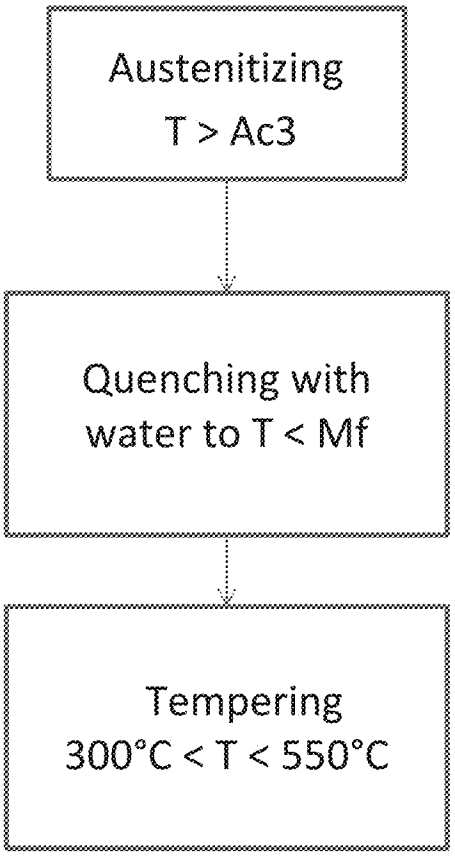
FIG. 1: shows a schematic illustration of the process steps of an embodiment of the method according to the invention.

As shown in FIG. 1, the first step is to heat the formed tubular product to a temperature above the Ac3 temperature of the steel alloy. Thereby, the structure is transformed into austenite. After austenitizing, the tubular product is quenched with water to a temperature below the martensite finish temperature (Mf). The tubular product is then heated to a temperature between 300 and 550° C. and tempered. The tempering duration can, for example, be 5 minutes.

As can be derived from the above, the silicon content in the steel from which the tubular product is made is adjusted so that the precipitation of cementite is effectively suppressed. The tempering of the steel is preferably carried out by the steps of austenitizing, quenching with water and tempering to a temperature below the formation temperature for special carbides. The alloy composition and the special heat treatment effectively suppress the formation of carbides.

With the present invention it is therefore possible to reduce the material ablation caused by corrosion, in particular highly localized corrosion in the form of pitting, without requiring the excessive use of expensive alloying elements, in particular chromium.

This invention has a number of advantages. By suppressing the carbides, the local chromium depletion of the steel can be effectively prevented. Pitting, in contrast to conventional, low-alloyed chromium steels, is only observed to a greatly reduced extent in this invention.

The carbide distribution in the structure of the tubular product according to the invention is characterized by an evenly distributed structure of very small carbides. By the alloy used according to the invention, the quantity and size of the carbides (special carbides, transition carbides, cementite) can be limited to a minimum. Relevant for the corrosion resistance are particularly chromium carbides, i.e. carbides that bind chromium, while niobium carbides, for example, do not significantly worsen the corrosion resistance.

As can be derived from FIGS. 2 to 5, which show transmission electron microscopy images, only smaller precipitates (see arrow) are present in the structure, which also exhibit low size-heterogeneity. These images also show the low density of the precipitates and their uniform size distribution.

Figure 6:
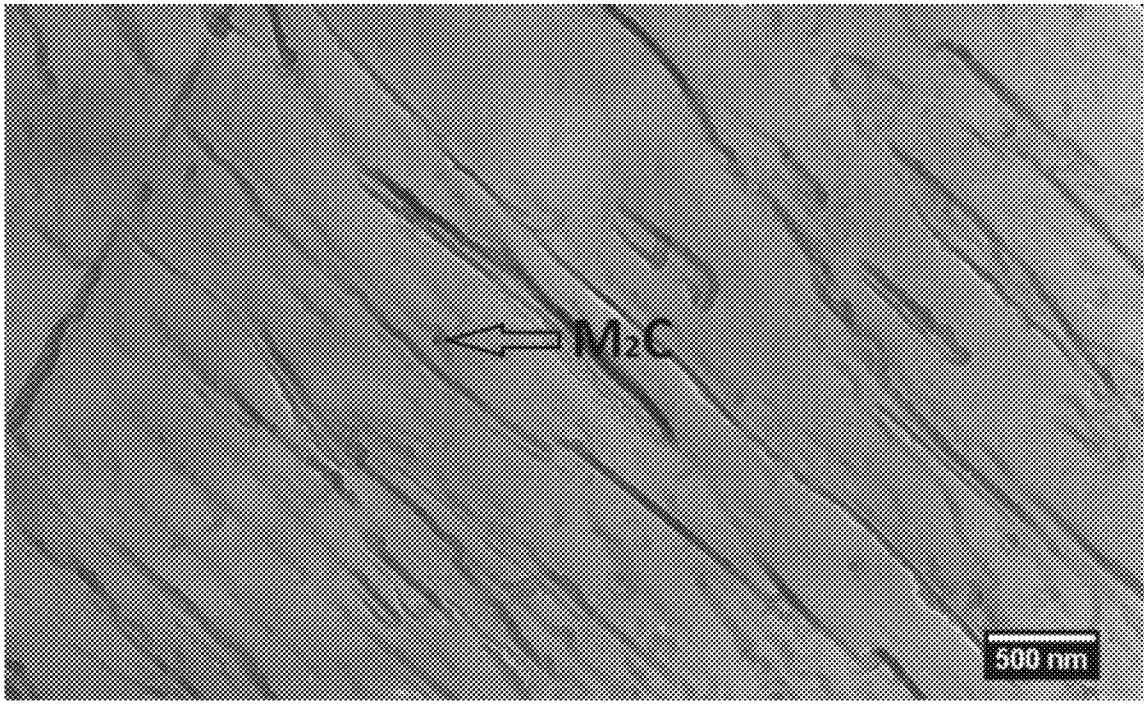

FIG. 6, which is also a TEM image, shows a detailed image of the structure of a tube according to the invention. This image shows the martensite structure in the form of martensite lancets and the very small precipitates within the martensite lancets. At the boundaries of the lancets there are only a few precipitates. The precipitate marked with the arrow in FIG. 6 was identified as $M_2C$ carbide by electron diffraction.

Figure 7:
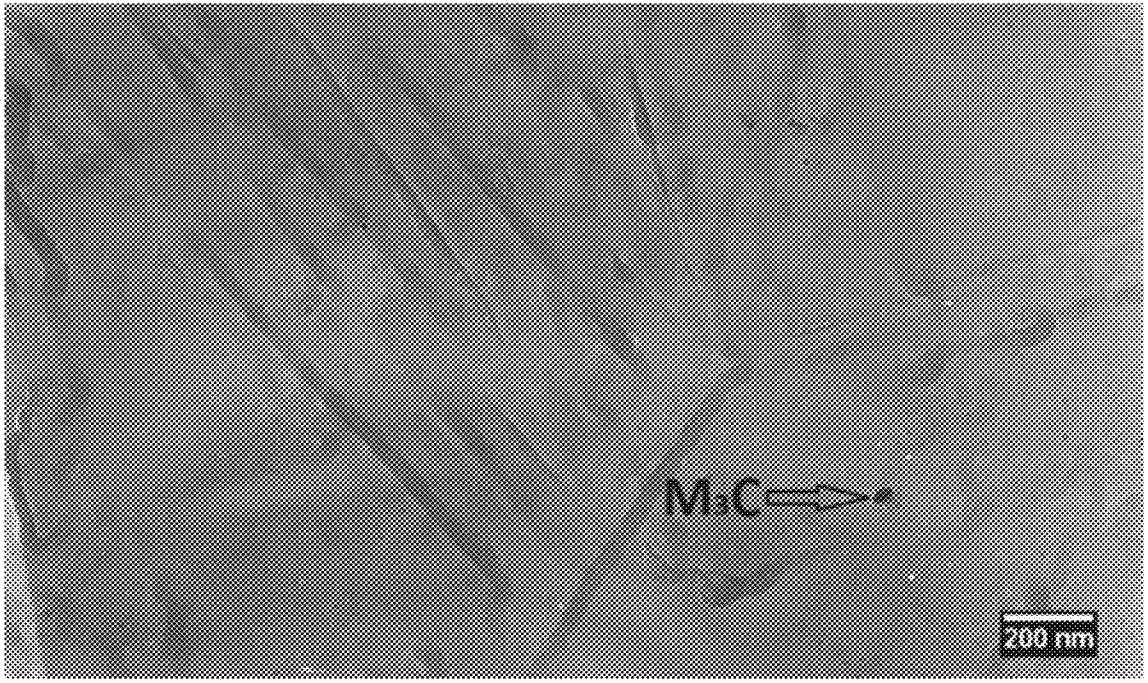

FIG. 7 shows a further detail image of small precipitates of different size within the martensite lancets. The particle marked with the arrow in FIG. 7 was identified as $M_3C$ carbide by electrode diffraction.

The average particle sizes and the number of carbides determined from the images of FIGS. 2 to 7 are shown in Table 1 below:

TABLE 1

Figure 2:
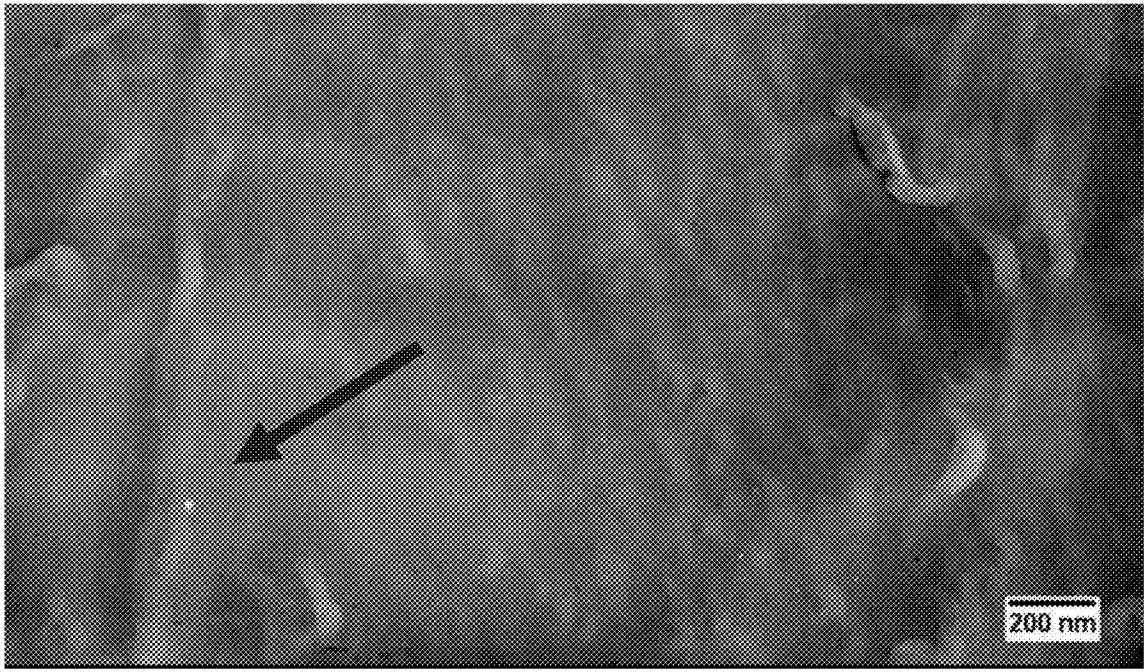
FIGS. 2 to 7: show TEM images of the structure of a tubular product according to the invention.
Figure 3:
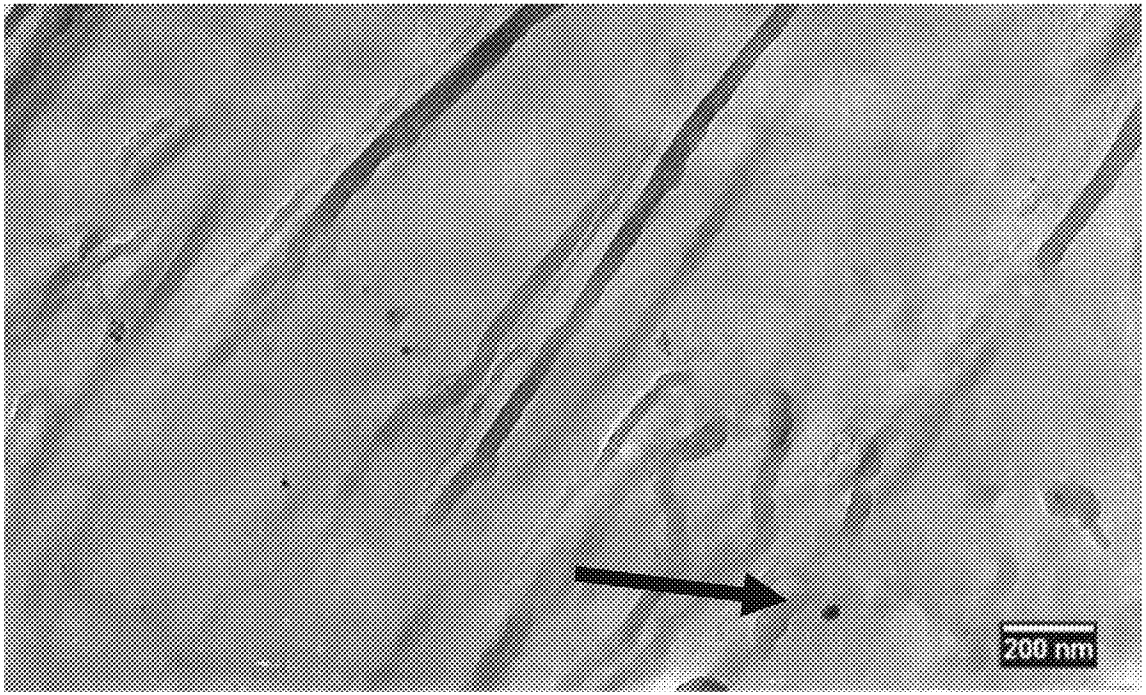
Figure 4:
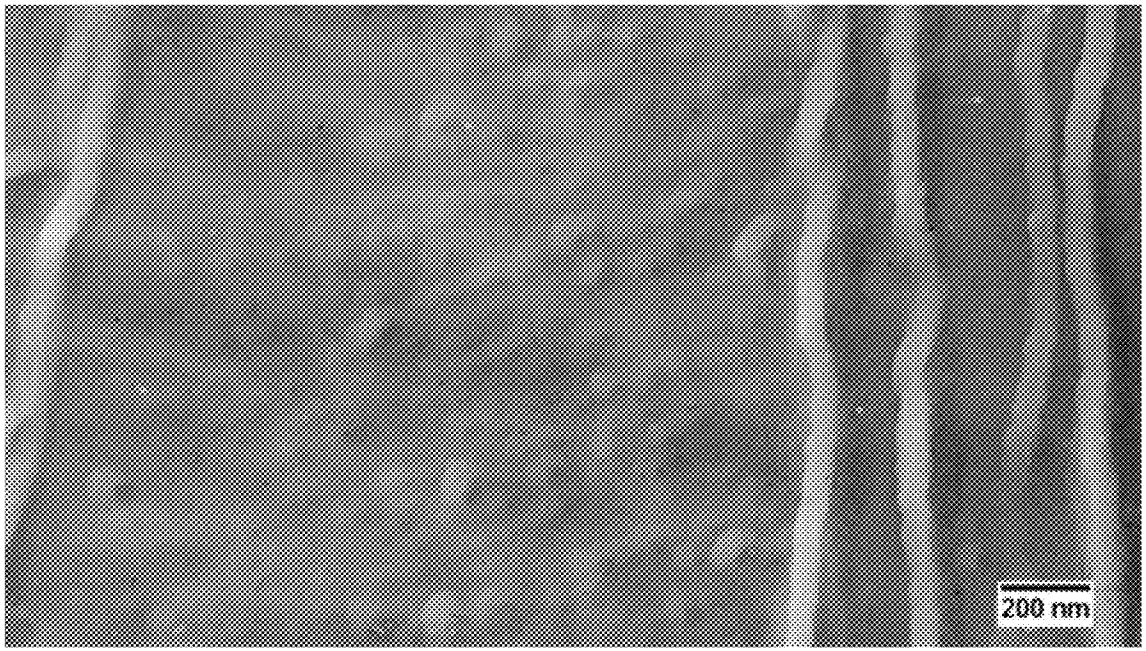
Figure 5:
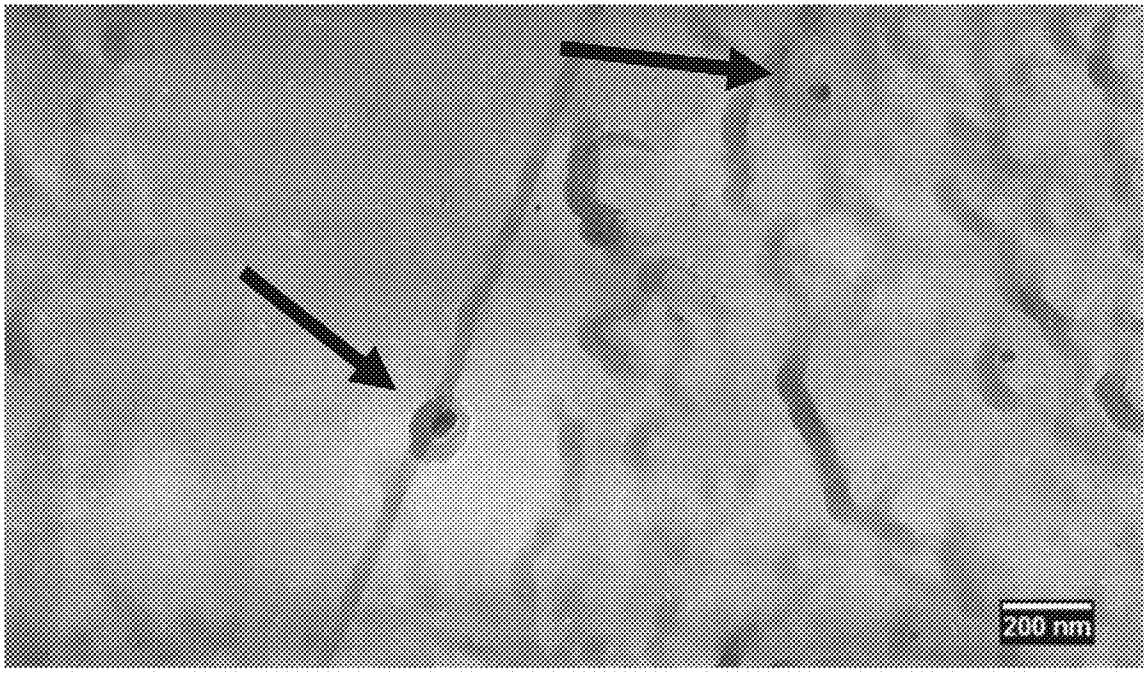

| | Statistical Parameters | |
|---|---|---|
| Figure analyzed | D ($10^{-9}$ m) | $N_V$ ($10^{20}$ $m^{-3}$) |
| FIG. 2 | 6 ± 3 | 3.667 |
| FIG. 3 | 7 ± 4 | 5.905 |
| FIG. 4 | 7 ± 3 | 5.524 |
| FIG. 5 | 8 ± 4 | 4.000 |
| FIG. 6 | 8 ± 4 | 3.143 |
| FIG. 7 | 6 ± 3 | 12.381 |
| Mean value | 7 ± 3 | 5.770 ± 3.116 |

Figure 8:
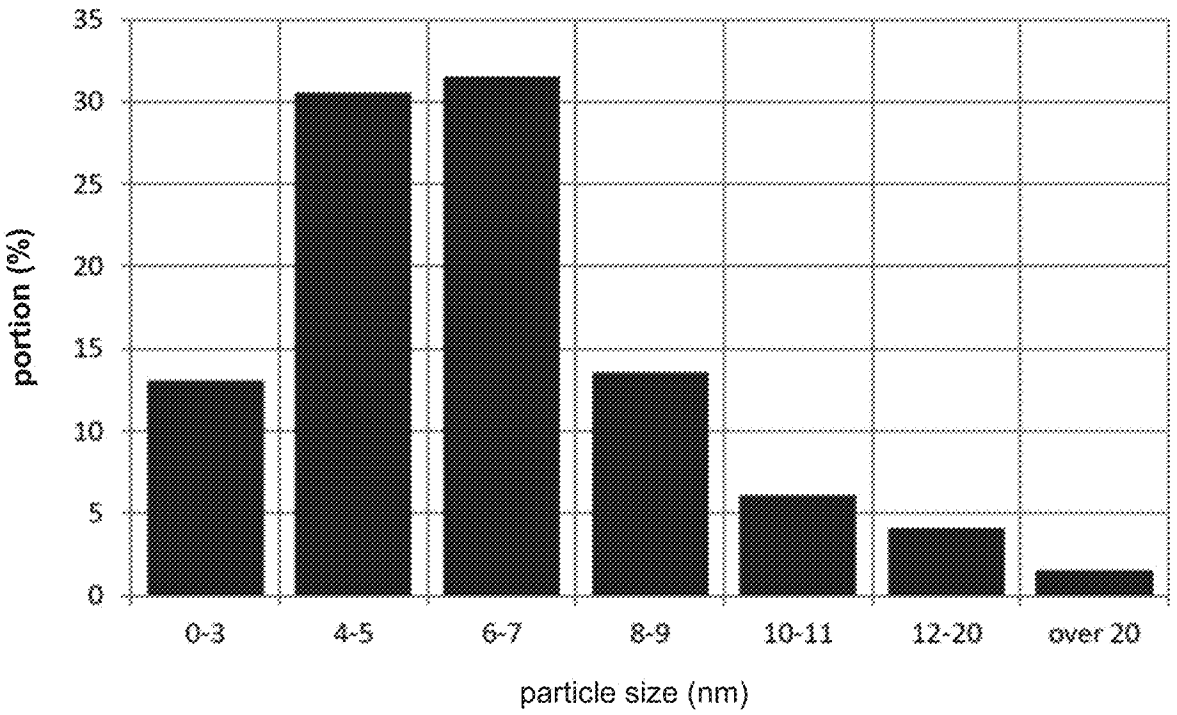
FIG. 8: shows a schematic diagram showing the distribution of the size of carbides in the structure of a tubular product according to invention.

The relative size distribution is shown schematically in a diagram in FIG. 8. This diagram shows that the largest portion (>30%) has a particle size in the range of 6-7 nm. Particle sizes of more than 20 nm are only present for less than 5% of the particles.

What is claimed is:

1. Tubular product, characterized in that it is manufactured from steel comprising chromium in a range of 3-7 wt. % and silicon in an amount of more than 1.0 wt. %, and the method of manufacturing comprises the steps of austenitizing, quenching and tempering at a tempering temperature in a range of 300° C. to 550° C.

2. Tubular product according to claim 1, characterized in that the steel consists, besides iron and unavoidable impurities, of the following alloying elements in wt. %:

| | |
|---|---|
| C | 0.05-0.3 |
| Si | 1.1-4 |
| Mn | 0.5-2.0 |
| Cr | 3-7 |
| Al | 0.01-0.1 |

and at least one of the following alloying elements in the specified ranges in wt. %:

| | |
|---|---|
| Nb | 0.001-0.1 |
| V | 0.001-0.2 |
| Ti | 0.001-0.1 |
| Mo | 0.001-0.7. |

3. Tubular product according to claim 2, characterized in that the manganese content is in the range of 0.5-1.0 wt. %.

4. Tubular product according to claim 2, characterized in that the aluminum content is 0.02 wt. %.

5. Tubular product according to claim 2, characterized in that the niobium content is 0.0175 wt. %.

6. Tubular product according to claim 1, characterized in that the silicon content is in a the range of more than 1 wt. % and up to 4 wt. %.

7. Tubular product according to claim 1, characterized in that an ablation of a surface is uniform in an event of corrosion.

8. Tubular product according to claim 1, characterized in that the tubular product has a yield strength of at least 550 MPa.

9. Tubular product according to claim 1, characterized in that the tubular product is a seamless tubular product.

10. Tubular product according to claim 1, characterized in that the tubular product has a structure of tempered martensite with a maximum retained austenite content of 20%.

11. Tubular product according to claim 1, characterized in that a density of carbides in the microstructure of the tubular product is below $10^{22}$ $m^{-3}$.

12. Tubular product according to claim 1, characterized in that a mean size of carbides in the microstructure of the tubular product is <20 nm.

13. Tubular product according to claim 1, characterized in that the silicon content is in a range of 1.1-3 wt. %.

14. Tubular product according to claim 1, characterized in that the silicon content is in a range of 1.5-2 wt. %.

15. Tubular product according to claim 1, characterized in that an ablation of a surface is uniform in an event of sweet gas corrosion.

16. Tubular product according to claim 1, characterized in that the tubular product has a yield strength of at least 1,100 MPa.

17. Tubular product according to claim 1, characterized in that a mean size of >50% of carbides in the microstructure of a tubular product is less than 15 nm.

* * * * *